US007077186B2

(12) United States Patent
Bowles et al.

(10) Patent No.: US 7,077,186 B2
(45) Date of Patent: Jul. 18, 2006

(54) HORIZONTAL CONTINUOUS CASTING OF METALS

(75) Inventors: Wade Lee Bowles, Spokane, WA (US); Jack Hamby, Chattaroy, WA (US); Alexander J. Fischer, Spokane, WA (US); David A. Salee, Spokane, WA (US)

(73) Assignee: Novelis Inc., Toronto (CA)

( * ) Notice: Subject to any disclaimer, the term of this patent is extended or adjusted under 35 U.S.C. 154(b) by 0 days.

(21) Appl. No.: 10/735,076

(22) Filed: Dec. 11, 2003

(65) Prior Publication Data

US 2005/0126745 A1 Jun. 16, 2005

(51) Int. Cl.
*B22D 11/00* (2006.01)

(52) U.S. Cl. ..... 164/490; 164/472; 164/475; 164/440; 164/485; 164/443

(58) Field of Classification Search ..... 164/490, 164/472, 475, 440, 485, 443
See application file for complete search history.

(56) References Cited

U.S. PATENT DOCUMENTS

| | | | | |
|---|---|---|---|---|
| 3,630,266 A | | 12/1971 | Watts | 164/73 |
| 3,667,296 A | | 6/1972 | Schiefer et al. | 73/304 R |
| 4,214,624 A | * | 7/1980 | Foye et al. | 164/487 |
| 4,593,742 A | | 6/1986 | Hazelett et al. | 164/416 |
| 4,598,763 A | | 7/1986 | Wagstaff et al. | 164/472 |
| 4,605,056 A | * | 8/1986 | Ohno | 164/490 |
| 4,653,571 A | | 3/1987 | Suzuki et al. | 164/490 |
| 4,668,554 A | * | 5/1987 | Thornton | 428/34.1 |
| 4,751,958 A | * | 6/1988 | Flowers et al. | 164/473 |
| 4,930,566 A | * | 6/1990 | Yanagimoto et al. | 164/475 |
| 5,179,346 A | * | 1/1993 | McGee et al. | 324/693 |
| 5,378,995 A | * | 1/1995 | Kudo et al. | 324/693 |
| 5,915,455 A | * | 6/1999 | Kittilsen et al. | 164/440 |
| 6,260,602 B1 | | 7/2001 | Wagstaff | 164/425 |
| 6,269,862 B1 | * | 8/2001 | Richards et al. | 164/472 |

FOREIGN PATENT DOCUMENTS

| | | | |
|---|---|---|---|
| CA | 2371700 | | 8/2000 |
| WO | 01/00352 | * | 1/2001 |
| WO | WO 01/00352 | | 1/2001 |

* cited by examiner

*Primary Examiner*—Kevin Kerns
*Assistant Examiner*—I.-H. Lin
(74) *Attorney, Agent, or Firm*—Cooper & Dunham LLP

(57) ABSTRACT

A mold for horizontal casting of molten metal comprising a mold body forming an open-ended mold cavity having an inlet end and an outlet end. An annular permeable wall member is mounted in the mold body adjacent the inlet end of the mold cavity with an inner face thereof forming an interior face of the mold. A refractory transition plate is mounted at the inlet end of the mold cavity, this transition plate providing a mold inlet opening having a cross-section less than that of the mold cavity. This provides an annular shoulder at the inlet end of the cavity. Means are provided for feeding molten aluminum through the inlet opening. Separate conduits are also provided for feeding a gas into the shoulder and via the permeable wall means for providing a layer of gas between the metal and the inner face of the mold. A gas that is more reactive with molten aluminum is fed into the shoulder and a less reactive gas is fed via the permeable wall. The reactions with the molten aluminum create a skin or shell on the aluminum which provides smooth passage through the mold and allows for more rapid secondary cooling of the emerging ingot.

32 Claims, 5 Drawing Sheets

HORIZONTAL CONTINUOUS CASTING OF METALS

FIELD OF THE INVENTION

This invention relates to horizontal continuous casting of metals, particularly light metals such as aluminum and its alloys.

DESCRIPTION OF THE PRIOR ART

In the continuous horizontal casting of metals, such as aluminum, the molten metal is held in an insulated reservoir and from there is fed into the inlet end of a horizontal open-ended mould cavity having a generally horizontal axis. Within the mould cavity the molten metal is initially chilled sufficiently to form a metal body comprising an outer skin or shell surrounding a still molten metal core. As this metal body emerges from the mould cavity, it is sprayed with liquid coolant, e.g. water, for further cooling and solidification.

The molten metal is fed into the mould cavity through an opening or nozzle having a smaller cross-section than that of the mould cavity, such that a lip or overhang is formed at the inlet end of the mould cavity. This metal inlet nozzle is typically a refractory plate with an inlet opening.

As the molten metal enters through the inlet nozzle and expands outwardly to fill the mould cavity, a metal meniscus is formed between the inlet overhang and the peripheral wall of the mould cavity. Behind this meniscus is a pocket of relatively metal-free space.

In order to achieve a smooth flow of metal through the mould cavity without adhering to the wall of the cavity, it is well known to inject both a gas and lubricant into the mould. In U.S. Pat. No. 4,157,728 a stream of pressurized air is introduced into the pocket behind the meniscus to expand the meniscus down the peripheral wall of the mould cavity. Additionally, an oil is fed in to lubricate the wall of the mould cavity.

Wagstaff et al., U.S. Pat. No. 4,598,763 describes a system for injecting a mixture of gas and lubricant into the mould cavity via a permeable wall portion of the peripheral wall of the mould cavity. The gas and lubricant are mixed in the permeable wall and are delivered to the peripheral wall of the cavity. In horizontal casting, the problem of preventing adherence is made more complex by the difference in metallostatic head between the top and bottom of the mould acting in combination with the different relationships between the refractory transition plate (disk shaped) and the mould wall (cylindrical). Injection of gas in such moulds can cause the oxide that forms on the surface of the emerging ingot to be unequally formed around the periphery of the emerging ingot with the resulting formation of surface defects.

Watts, U.S. Pat. No. 3,630,266 describes a horizontal caster where gas is injected by passageways into the mould pocket, e.g. behind the meniscus. The gas may contain various lubricants and the flow is controlled by metal head measurements.

In Suzuki et al., U.S. Pat. No. 4,653,571 gas is also introduced into the inlet corners of the mould, i.e. the pocket behind the meniscus. This design uses separate channels for introducing gas and lubricant and provides channels to control the escape of gas in certain locations around the mould.

In Johansen et al., International Application WO 91/00352, a permeable wall around the periphery of the mould is supplied by gas from separate segments around the mould.

In Wagstaff, U.S. Pat. No. 6,260,602 a continuous horizontal casting system is described in which the mould cavity has an outward taper and water jets for cooling are in a staggered configuration. The degree of taper and the positioning of the water jets around the mould may be varied to balance the splaying forces with thermal contraction forces and thus achieve a desired ingot shape. Thus, it can be used in a horizontal caster to obtain an ingot of circular cross-section from a mould where the metal is subjected to unequal gravitational forces.

In Ohno, U.S. Pat. No. 4,605,056 a continuous horizontal casting system is described in which an auxiliary heating system is provided within the mould to delay the metal solidification.

The formation of a consistent surface on the metal body formed within the mould is an important aspect of horizontal continuous casting. For instance, an inconsistent or uneven outer shell or skin within a mould may stick to the mould resulting in an irregular surface on a cast ingot or "break out" of molten metal may occur.

It is an object of the present invention to provide an improved method of controlling the smooth passage of the metal through a horizontal mould cavity and thereby to achieve a cast billet with improved surface properties.

It is a further object of the present invention to be able to increase the heat flux through the emerging ingot surface and achieve a more rapid solidification of the cast ingot.

It is yet a further objective of the present invention to obtain a cast billet having an improved microstructure.

It is yet a further objective of the present invention to provide a means of reliably controlling the use of lubricant to improve the surface quality of the cast billet.

SUMMARY OF THE INVENTION

In one aspect, the present invention relates to a mould for horizontal casting of molten metal comprising a mould body forming an open-ended mould cavity having an inlet end and an outlet end. An annular permeable wall member is mounted in the mould body adjacent the inlet end of the mould cavity with an inner face thereof forming an interior face of the mould. A refractory transition plate is mounted at the inlet end of the mould cavity, this transition plate providing a mould inlet opening having a cross-section less than that of the mould cavity. This provides an annular shoulder at the inlet end of the cavity. Means are provided for feeding molten aluminum through the inlet opening. Separate conduits are also provided for feeding a gas into the shoulder and the inner face via the permeable wall means.

The gas fed to the shoulder forms a pocket of metal-free space behind a metal meniscus that forms at the corner between the shoulder and the cavity wall.

The gas feed to the inner face forms a layer of gas between the metal and the cavity wall.

Preferably a lubricant is also fed by a conduit to flow into the permeable wall means. This conduit is located between the two gas conduits.

In one embodiment the gas conduit feeding the shoulder communicates with the metal-free space or pocket at the corner behind the metal meniscus by means of a plurality of grooves or fine channels. In a particularly preferred embodiment this gas conduit communicates with the metal-free pocket via a portion of the permeable wall means.

The two gas conduits are preferably fed with different gases, the gas communicating with the metal-free pocket being more reactive to molten aluminum than the gas communicating with the inner face of the mould.

The more reactive gas that is used is one that reacts with the molten aluminum, e.g. oxygen, air, silane, $SF_6$ or methane, including mixtures of such gas in an inert gas to form a skin or shell thereon. When oxygen, air or a mixture of these gases in an inert gas is used (i.e. the reactive gas is an oxidizing gas), the skin comprises oxides of aluminum and/or some of its alloying elements. The less reactive gas that is used is one that reacts comparatively less with the molten aluminum and may include air, nitrogen or pure inert gas. Air can be a less reactive (i.e. oxidizing) gas only when used with a more reactive gas than air in the metal free pocket.

By using the two stage injection of gas rather than the single stage injection of the prior art, a engineered film of reaction products (most frequently oxides) containing aluminum alloy components is generated on the molten metal meniscus surface. In particular, the use of the more reactive gas in the upstream location maintains the shoulder free of metal against the metallostatic head, whilst ensuring the rapid formation or repair of a strong supporting reaction product film on the surface, whereas the less reactive gas downstream ensures minimal contact between the reaction product film and the mould walls and at the same time minimizes the detrimental effects of lubricant reaction with the gas that would occur if the same gas were used throughout. This combination thereby ensures that the heat flux between the metal and the mould walls is reduced (i.e. in the area of so-called primary cooling) and that the ingot emerges from the mould with a high surface temperature and the cooling and solidification is done almost entirely by the application of the secondary coolant directly to the emerging surface. The heat flux through the surface at the secondary coolant impingement point is thereby greatly increased and an elevated solidification rate results across essentially the entire billet diameter.

This means that a solidification rate of more than 100° C./sec is possible, resulting in a billet having a fine grain structure. The invention therefore further relates to a cast billet product having a radially uniform as-cast microstructure having an average cell-size (inter-dendritic arm spacing of less than 10 microns). The billet further has a surface roughness ($R_z$) of less than about 50 microns over at least 50% of any circumferential surface of the emerging cast billet.

The amount of lubricant added in the present invention is low, and is used mainly to improve the efficacy of the permeable wall means for conducting gas from the conduit feeding the inner surface of the mould to the surface. This requires minimal lubricant. It is, therefore advantageous to provide a rather precise means for determining the lubricant requirement. According to a further preferred feature of the invention, detectors are located to measure the electrical resistance between the mould cavity wall and molten metal in the mould. The flow of lubricant is varied based on the measured resistance.

BRIEF DESCRIPTION OF THE DRAWINGS

In the drawings that illustrate certain preferred embodiments of the invention.

DETAILED DESCRIPTION

Figure 1:
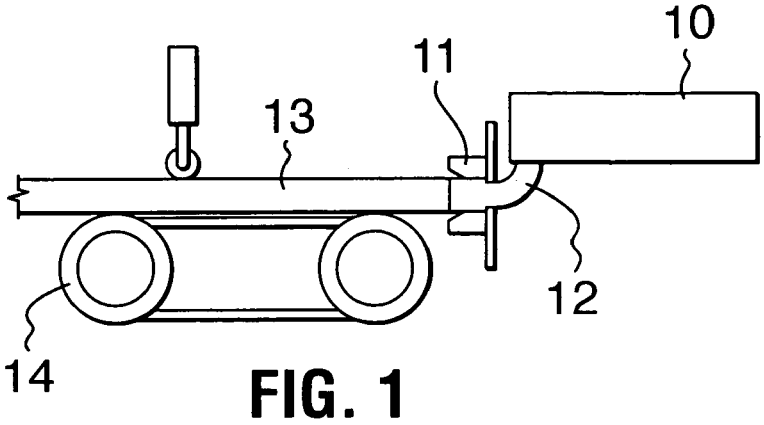
FIG. 1 is a simple elevation of a typical horizontal casting device.

FIG. 1 shows a typical horizontal casting mould of the type to which the present invention relates, including an insulated molten aluminum reservoir 10, an inlet trough 12 and a horizontal casting mould 11. An ingot 13 is delivered from the mould and is carried from the mould by a conveyor 14.

Figure 2:
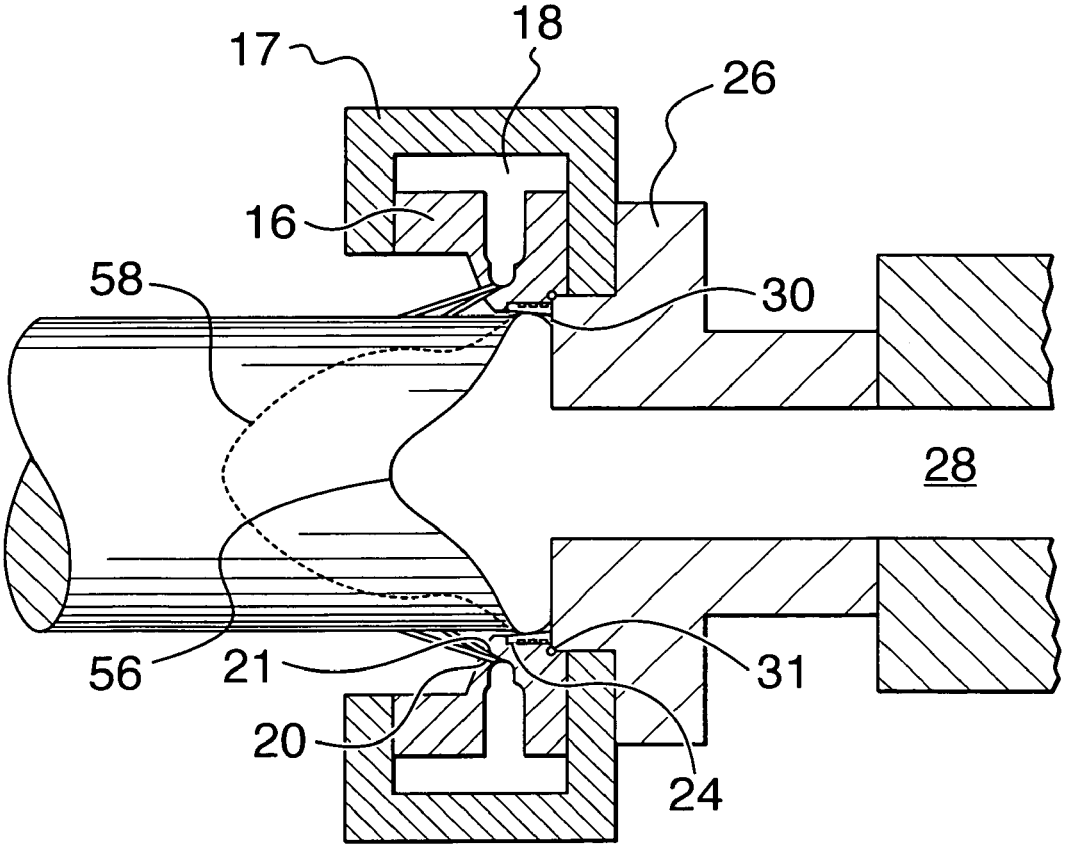
FIG. 2 is a cross-sectional view of a mould according to this invention.

In FIG. 2 a two-part mould body 16, 17 is shown, in which is contained a water channels 18 fed by coolant delivery pipe (not shown) and communicating with a set of staggered coolant outlet holes 20, 21 around the periphery of the mould body.

A tapered permeable graphite annular ring 24 is mounted inside the mould body 16 so as to form an inner surface to the mould. A transition plate 26 formed from refractory material is mounted at the upstream. (or metal entry end) 28 of the mould. It has a smaller interior cross-sectional opening than the annular ring 24 thereby forming a shoulder and pocket 30 in the corner of the mould. An O-ring seal 31 is provided at the intersection of the refractory ring 26, the graphite ring 24 and the mould body 16.

The coolant outlet holes 20, 21 may have variable spacing and be directed at different angles with respect to the mould axis and the taper of the graphite ring 24 may be varied around the periphery of the mould as further described in U.S. Pat. No. 6,260,602, incorporated herein by reference. This variation is used to compensated for the vertical asymmetry that occurs in horizontal casting as exemplified by the asymmetry evident in the solidification front represented by the solid line 56 present in the casting. The entry opening in the transition plate may also be made-non-circular and located off centre to compensate for this asymmetry when a circular billet is to be cast.

Gas and lubricant (when used) may be delivered to the interior of the mould in various ways as shown in FIGS. 3*a* to 3*d*.

Two annular channels 32, 34 are machined in the outer face of the annular ring 24 and are provided with feed connections (not shown) through the mould body. The annular channels 32 and 34 are fed with gas via separate feed connections. In a particularly preferred embodiment, channels 32 and 24 are fed with different gases, channel 32 (closest to the entrance to the mould) is fed with a more reactive gas than channel 34 (further from the mould entrance), for example a mixture of oxygen in argon and pure argon respectively.

Figure 3A:
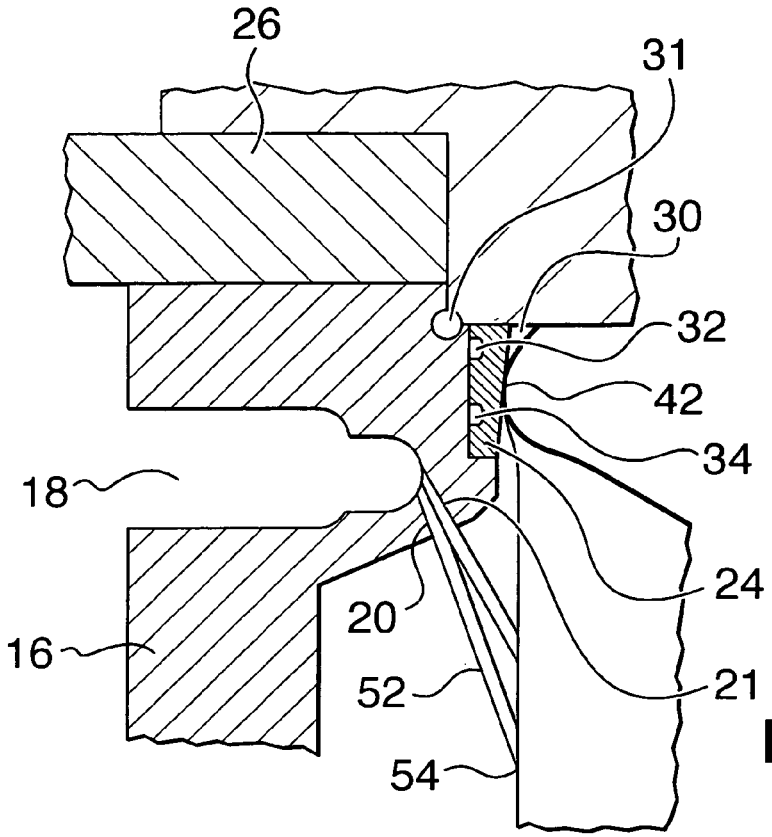
FIGS. 3*a*, 3*b*, 3*c* and 3*d* are partial cross-sectional view of a mould of this invention showing a various gas and/or lubricant feed embodiments.

In FIG. 3*a* gas fed via annular channel 32 flows through the permeable ring 24 to fill the metal free pocket formed in the adjacent shoulder 30 of the mould and gas fed via annular channel 34 flows through the permeable graphite ring 24 and forms a gas layer at the adjacent interface between the metal body 40 in the mould and the inner face of the mould 42.

Figure 3B:
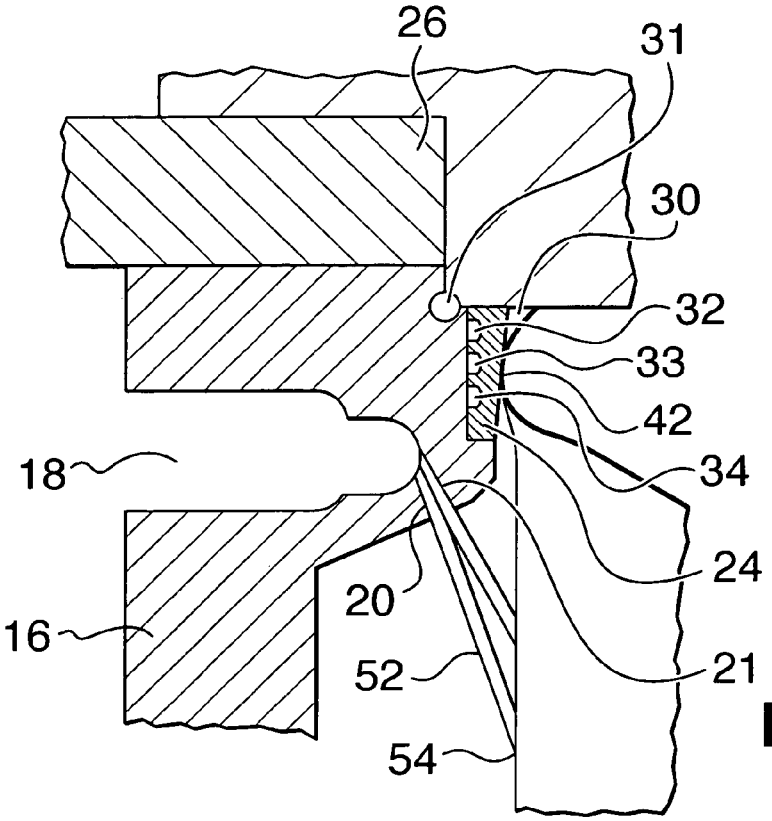
Figure 3C:
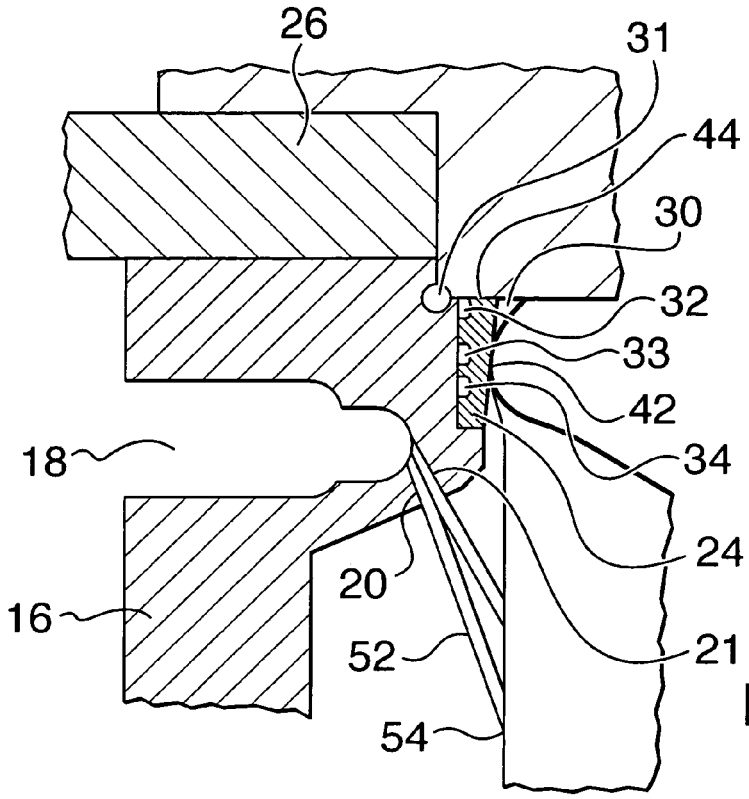
Figure 3D:
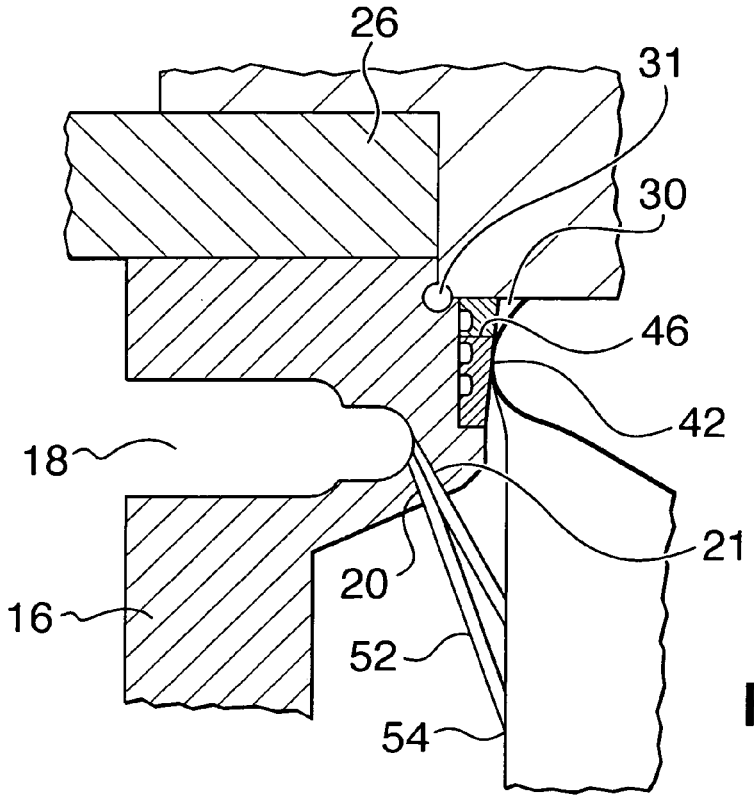

In FIGS. 3*b* to 3*d*, an additional annular channel 33 is provided in the outer face of the graphite ring that is fed by lubricant via one or more connections through the mould body (not shown. The lubricant permeates the porous graphite ring 24 to facilitate the gas feed though the material. In FIG. 3*b* the gases are fed and communicate with the mould interior as in FIG. 3*a*, except that the presence of the lubricant provides for a more controllable gas flow.

The gas and lubricant feeds are controlled by control valves and metering devices of known design (not shown).

In FIG. 3*c*, the annular channel 32 is positioned at one end of the graphite ring 24 and gas is fed from annular channel 32 to the pocket 30 via a plurality of fine holes or grooves 44 grooves on the edge of the graphite ring).

In FIG. 3*d*, gas is fed in a similar manner as in FIG. 3*b* except that an impermeable barrier 46 is provided within the graphite ring 24 separating it into two portions, one of which is used to feed gas from the annular channel 32 and the other to feed gas/lubricant from the annular channels 33 and 34. This prevents lubricant from entering the upper portion of the graphite ring and coming in contact with the gas fed from the channel 32. It also more effectively isolates the two gas streams from each other. The impermeable barrier may also be positioned so that gas and lubricant are fed to the upper portion of the graphite ring and the pocket whereas only gas is fed to the lower portion of the graphite ring.

In some embodiments the gas may contain liquids, for example in the form of droplets forming a mist and in other embodiments the gas may be contained within a liquid for delivery, for example in the form of an emulsion. The liquid is generally a lubricant.

In other embodiments the lubricant may also contain a gas, for example by forming an emulsion of the gas in the lubricant before it is delivered to the feed channel. If this gas is reactive with the gas delivered to the pocket, then the reaction product can be used to modify the engineered surface of reaction product.

Because of the injection of gas into the pocket 30 as well as at the mould face 42, the metal body 40 forms an engineered surface of reaction product (generally oxides of the aluminum and/or some of its alloying elements) on the outer surface. This provides a greater degree of thermal isolation from the mould face 42 than normally found in casting moulds and is therefore insulated from the usual indirect cooling within the mould cavity. Consequently the billet emerges from the mould at a higher surface temperature than is usually encountered. The secondary coolant 52 therefore impinges on the surface 54 with a much higher heat flux than normally occurs because of the elevated temperature differential between the ingot surface and the coolant. The result is that (a) a shallower liquid metal sump forms in the emerging billet and (b) an elevated solidification rate occurs across the diameter of the billet. A solidification rate in excess of 100° C./sec (compared to the normal 5 to 30° C./sec) is obtained, resulting in a uniform fine-grained structure across the diameter of the billet.

In FIG. 2 a typical solidification front (i.e. end of the molten metal sump) 56 is shown as a solid line that can be compared to the solidification front 58 and substantially deeper sump typical of prior art casting moulds.

Use of a casting mould as in the present invention results in a uniform, fine grained billet having good surface properties. To further enhance the surface properties it has been found useful to treat the refractory transition plate to reduce its reactivity to molten aluminum. Most such transition plates are fabricated from silica containing refractory material which is attacked by molten aluminum. The result is a decrease in ingot surface quality. One such means of protection is to use barium oxide or barium sulphate additions to the refractory, for example as produced by the methods of co-pending application Ser. No. 10/735,076 filed Dec. 11, 2003, entitled "Horizontal Continuous Casting of Metals", assigned to the same assignee as the present invention, the disclosure of which is incorporated herein by reference and suitable metal feed troughs and transfer sections are more fully described in co-pending application Ser. No. 10/735,057 filed Dec. 11, 2003, entitled "Method for Suppressing Reaction of Molten Metals with Refractory Materials", assigned to the same assignee as the present invention, the disclosure of which is incorporated herein by reference.

Figure 4:
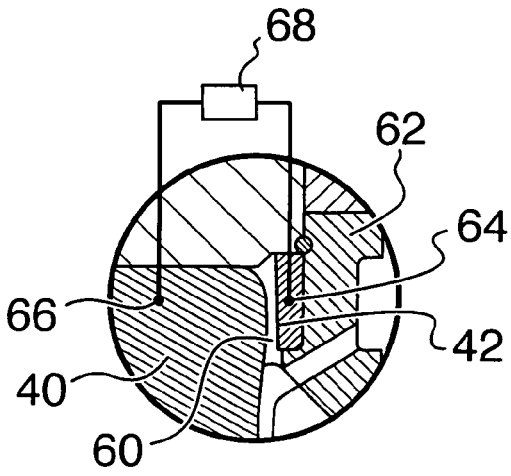
FIG. 4 is a cross-sectional view showing a resistance measuring device with an air gap in the mould.
Figure 5:
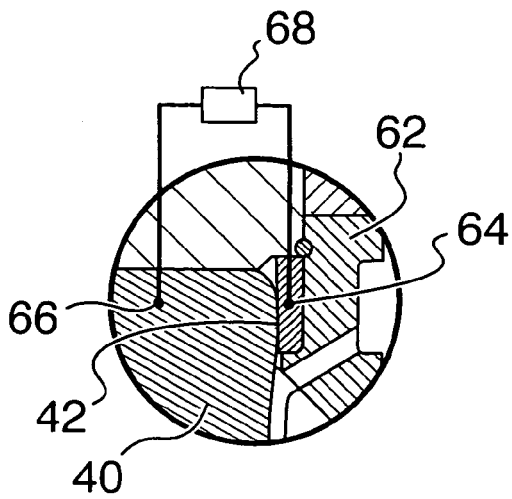
FIG. 5 is a cross-sectional view showing the resistance measuring device with no air gap in the mould.

It is highly desirable to be able to use the minimum amount of lubricant during the casting of an ingot and the enhanced formation of an engineered oxide surface on the metal being cast according to the present invention makes possible a reduction in the quantity of lubricant required since the containment of the metal relies on the engineered oxide surface so formed and less on the surface of the mould. The air and lubricant fed to the mould face via the annular permeable graphite ring creates an air cushion at the surface. The preferred operating position is as shown in FIG. 4 with a small gap 60 between the metal body 40 being cast and the cavity face 42. This position requires the least amount of lubricant. FIG. 5 shows the position where the gap has not been maintained and the metal body 40 has come into substantial contact with the cavity face 42 at which point the billet is susceptible to sticking and tearing. It has been found that this lubricant requirement can be automatically controlled by measurement of the resistance between the molten metal body 20 and the mould 62. This is accomplished by installing electrodes 64 and 66 so that the resistance between the molten aluminum and the mould can be measured. These electrodes connect to a resistance measuring device 68.

Figure 6:
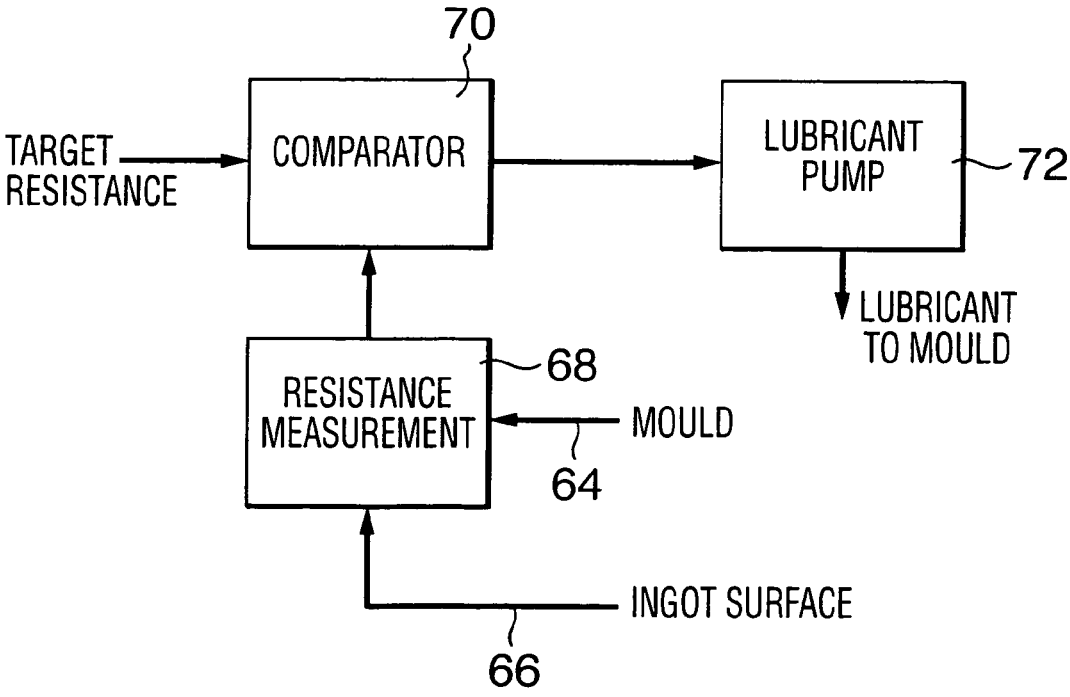
FIG. 6 is a block diagram for operation of the resistance measuring.

As shown in FIG. 6, inputs from electrodes 64 and 66 are fed to the resistance measuring device 68 and a resistance reading is obtained. This is fed to a comparator 70 where the resistance is compared to a target resistance. As the mould approaches the condition shown in FIG. 6, the resistance increases and this provides a signal to lubricant pump 72 to increase the flow of lubricant.

Figure 7:
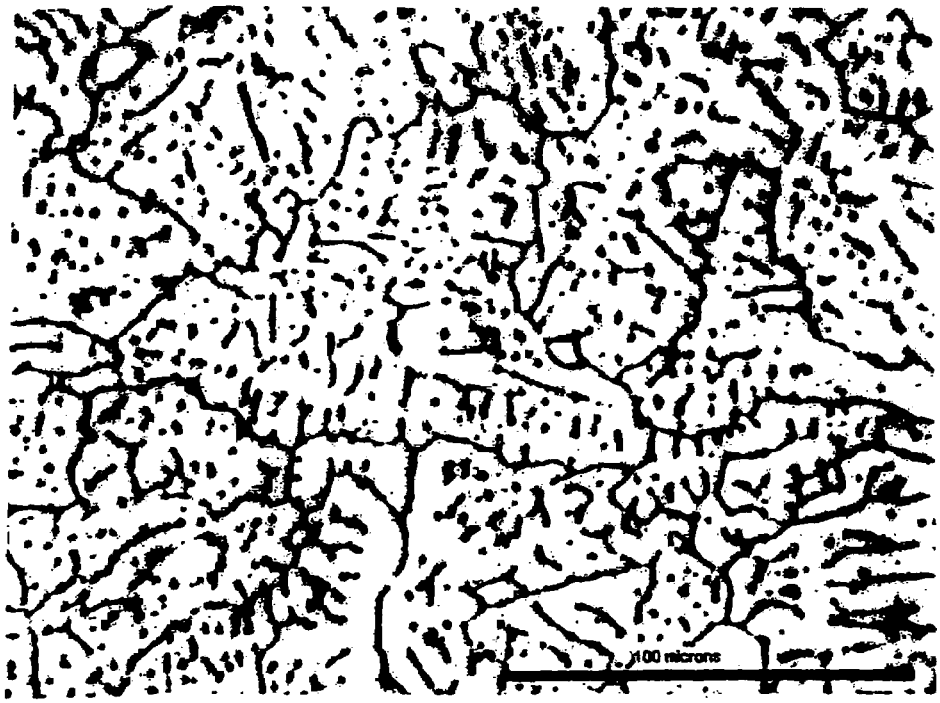
FIG. 7 is a micrograph showing the as-cast microstructure of a billet cast using the present invention.

FIG. 7 is a micrograph showing a portion of a cross-section of a billet cast in the mould and in accordance with the method of the present invention. The measured average inter-dendritic spacing is less than about 10 microns and substantially the same spacing is measured at all radial locations in the billet. The roughness of the billet surface (measured as $R_z$) over a 0.5 inch length on the surface is typically less than 50 microns over most of the surface and usually less than 30 microns. There are some portions of the surface exhibiting larger $R_z$, but it is a characteristic of the product of the present invention that the roughness ($R_z$) is less than 50 microns over at least 50% of the circumferential surface of the billet.

We claim:

1. A mould for horizontal casting of molten aluminum comprising a mould body forming an open ended mould cavity having an inlet end and an outlet end, a first annular permeable wall member mounted in the mould body adjacent the inlet end of the mould cavity with an inner face thereof forming an interior face of the mould, a refractory transition plate mounted at the inlet end of the mould cavity, said transition plate providing a mould inlet opening having a cross-section less than that of the mould cavity and thereby providing an annular shoulder at the inlet end of the cavity, feed means for feeding molten aluminum through said inlet opening, and first and second conduits each connected to a gas feed feeding a gas into said mould cavity, said first conduit being positioned closer to the annular shoulder than the second conduit and said feed for said first conduit feeding a gas that is reactive with molten aluminum, whereby the first conduit is adapted to form a metal free pocket at the corner of the shoulder and cavity wall and the second conduit is adapted to feed gas through said permeable wall means to contact the metal adjacent the interior face of the mould.

2. A mould as claimed in claim 1 in which the first conduit connects via the permeable wall to the pocket for feeding gas to the pocket.

3. A mould as claimed in claim 1 in which the first conduit connects via grooves to the pocket for feeding gas into the pocket.

4. A mould as claimed in claim 1 which includes a third conduit connected to a lubricant feed feeding a lubricant into the permeable wall member, said third conduit being located between the first conduit and the second conduit.

5. A mould as claimed in claim 4 which also includes an impermeable barrier in the permeable wall means located between the first conduit and the third conduit.

6. A mould as claimed in claim 4 which also includes an impermeable barrier in the permeable wall means located between the second conduit and the third conduit.

7. A mould as claimed in claim 1 wherein the second conduit is connected to a gas feed feeding a less reactive gas than said gas of said feed connected to said first conduit.

8. A mould as claimed in claim 1 that includes detectors located to measure the electrical resistance between the mould cavity wall and molten metal present in the mould during casting.

9. A mould as claimed in claim 1 wherein the mould cavity is outwardly tapered in the direction of metal flow.

10. A mould as claimed in claim 9 wherein the taper varies around the circumference of the mould cavity.

11. A mould as claimed in claim 1 wherein the mould inlet opening is non-circular in cross-section to produce an ingot having a circular cross-section.

12. A mould as claimed in claim 11 wherein the mould inlet opening is positioned asymetrically.

13. A mould as claimed in claim 1 wherein the mould body includes coolant delivery channels connected to coolant discharge openings at the outlet end of the mould.

14. A mould as claimed in claim 13 wherein the coolant discharge openings are in staggered locations and the opening sizes and discharge angles are varied around the mould.

15. A method for horizontal continuous casting of molten aluminum comprising:

continuously feeding molten aluminum from a feed trough through an opening in a refractory transition plate at the inlet end of an open ended mould cavity formed within a mould body, said transition plate providing a mould inlet opening having a cross-section less than that of the mould cavity thereby providing a shoulder around the inlet end of the mould cavity, within the mould cavity moving the molten aluminum past a permeable refractory wall portion forming part of the interior face of the mould cavity with the formation of a metal meniscus adjacent the shoulder, directing a first flow of a gas reactive with the aluminum into the shoulder to form a metal-free pocket and into contact with the molten aluminum to thereby form an aluminum body having an outer surface comprising a reaction product of the gas with the aluminum, and directing a second flow of gas into the mould cavity and into contact with a skin of the aluminum body downstream from said first gas flow.

16. A method as claimed in claim 15 wherein the gas that is reactive with aluminum is selected from the group consisting of oxygen, air, silane, $SF_6$ and methane or a mixture of an inert gas with one or more of said group.

17. A method as claimed in claim 16 wherein said reactive gas is a mixture of argon and oxygen.

18. A method as claimed in claim 15 wherein the second flow of gas passes through the permeable wall portion.

19. A method as claimed in claim 18 wherein the gas in the second flow is less reactive with aluminum than the gas in the first flow.

20. A method as claimed in claim 18 wherein the gas is selected from the group consisting of air, nitrogen and an inert gas.

21. A method as claimed in claim 20 wherein the gas is argon.

22. A method as claimed in claim 18 wherein a flow of lubricant is fed through the permeable wall portion and into contact with the skin of the aluminum body at a location between the first gas flow and the second gas flow.

23. A method as claimed in claim 22 wherein the flow of lubricant is prevented from coming into contact with the first gas flow before the first gas flow enters the mould cavity.

24. A method as claimed in claim 22 wherein the flow of lubricant is prevented from coming into contact with the second gas flow before the second gas flow enters the mould cavity.

25. A method as claimed in claim 22 wherein the lubricant contains a gas.

26. A method as claimed in claim 25 wherein the gas in the lubricant reacts with the gas in the pocket to form a modified reaction product on the aluminum body.

27. A method as claimed in claim 15 wherein the gas is fed as a gas, a gas containing a liquid or a liquid containing a gas.

28. A method as claimed in claim 15 wherein the molten aluminum is fed through a mould inlet opening that is non-circular in cross-section to obtain an ingot having a circular cross-section.

29. A method as claimed in claim 28 wherein the molten aluminum is fed through a mould inlet opening that is positioned asymmetrically.

30. A method as claimed in claim 15 wherein streams of coolant liquid are directed onto a forming ingot as it emerges from the mould cavity.

31. A method as claimed in claim 30 wherein the coolant liquid cools the forming ingot at a rate of more than 100° C./sec. thereby forming a fine grain structure within the ingot.

32. A method as claimed in claim 15 wherein an electrical resistance is measured between the mould and an ingot being formed within the mould and the flow of lubricant to the permeable wall of the mould is varied based on the measured resistance.

* * * * *